US007044328B1

(12) United States Patent
Ciavarella

(10) Patent No.: US 7,044,328 B1
(45) Date of Patent: May 16, 2006

(54) TAMPER PROOF LATCH FOR DISPENSERS

(75) Inventor: Nick E. Ciavarella, Seven Hills, OH (US)

(73) Assignee: Joseph S. Kanfer, Richfield, OH (US)

( * ) Notice: Subject to any disclaimer, the term of this patent is extended or adjusted under 35 U.S.C. 154(b) by 165 days.

(21) Appl. No.: 10/190,090

(22) Filed: Jul. 8, 2002

(51) Int. Cl.
*B65D 43/22* (2006.01)
*B65D 45/18* (2006.01)
*E05C 1/06* (2006.01)

(52) U.S. Cl. ..... 220/835; 220/326; 292/146; 292/150; 292/152; 292/DIG. 11; 292/DIG. 38; 292/DIG. 53; 292/DIG. 63

(58) Field of Classification Search ..... 220/835, 220/421, 478, 263, 323–326, 244; 292/56, 292/64–66, 69, 80, 81, 86, 85, 100, 102, 292/107, 137, 138, 146, 150, 152, DIG. 11, 292/DIG. 38, DIG. 53, DIG. 63
See application file for complete search history.

(56) References Cited

U.S. PATENT DOCUMENTS 3,125,407 A * 3/1964 Kagan ..... 422/123
3,532,245 A * 10/1970 Edwards et al. ..... 220/478
4,621,749 A 11/1986 Kanfer
4,901,882 A * 2/1990 Goncalves ..... 220/324
4,952,160 A * 8/1990 Olsen ..... 439/142
5,265,772 A 11/1993 Bartasevich
5,348,356 A * 9/1994 Moulton ..... 292/80
5,370,267 A 12/1994 Schroeder
5,443,236 A 8/1995 Bell et al.
5,465,877 A 11/1995 Bell et al.
5,625,659 A 4/1997 Sears
5,682,910 A * 11/1997 Kizawa et al. ..... 132/293
5,706,968 A * 1/1998 Riley ..... 220/326
5,944,227 A 8/1999 Schroeder et al.
6,006,941 A * 12/1999 Hitchings ..... 220/284
6,032,817 A * 3/2000 Ejima et al. ..... 220/284
6,127,630 A * 10/2000 McKenzie et al. ..... 174/58
D433,938 S 11/2000 Polan
6,158,620 A 12/2000 Polan
6,216,916 B1 4/2001 Maddox et al.
6,390,329 B1 5/2002 Maddox
6,395,234 B1 * 5/2002 Hunnell et al. ..... 422/101

* cited by examiner

*Primary Examiner*—Lee Young
*Assistant Examiner*—Niki M. Eloshway
(74) *Attorney, Agent, or Firm*—Renner, Kenner, Greive, Bobak, Taylor & Weber

(57) ABSTRACT

A latching system for use with a dispenser having a cover hingedly connected to a back plate for movement between open and closed positions. The cover includes a latch plate or tongue which is disposed adjacent its top or now hinged end. The latch plate has one or more through apertures therein for engagement with an engagement bar carried by the back plate with the engagement bar having one or more upwardly projecting ribs for engagement with the apertures of the latch plate when the cover is closed. The back plate also carries a movable latch bar selectively movable into contact with the latch plate to disengage the latch plate from the projecting ribs. The back plate also includes one or more projecting support ribs underlying the cover it its closed position.

3 Claims, 5 Drawing Sheets

TAMPER PROOF LATCH FOR DISPENSERS

RELATED PATENT APPLICATIONS

None.

FIELD OF THE INVENTION

This invention relates in general to wall-mounted dispensers and relates in particular to such a dispenser having a back plate and a cover hingedly secured thereto and to an improved latch whereby the cover is releasably secured to the back plate in the closed position in a secure, tamper proof fashion.

BACKGROUND OF THE INVENTION

Various products, such as hand soap, lotions, etc., are commonly dispensed through the use of wall-mounted dispensers. These dispenser are found in a wide range of facilities ranging from the home to industrial establishments.

In general, dispensers of this general nature include a mounting plate or back plate which is attached to a vertical surface, such as a wall, and a cover which is hinged to the back plate and movable between open and closed positions.

The contents to be dispensed are contained within a container which rests on the back plate and generally are dispensed by activating a push bar or activating member attached to the cover either on the front or beneath it in order to activate a pump. In that regard, the container bearing the material to be dispensed, such as soap, for example, carries with it a pump which is attached to the container and is disposed generally adjacent the lower portion of the cover so that activation of the push bar or activating member activates the pump to dispense a measured charge of material.

Various latch designs have been developed in order to retain the cover in its closed or operating position and, in view of the wide range of facilities in which these dispensers are used, they do tend to incur a large amount of abuse and unauthorized opening. Examples can be seen in Kanfer U.S. Pat. No. 4,621,749; Bartasevich U.S. Pat. No. 5,265,772; Schroeder U.S. Pat. No. 5,370,267; Bell U.S. Pat. No. 5,443,236; Bell U.S. Pat. No. 5,465,877; Sears U.S. Pat. No. 5,625,659; Schroeder U.S. Pat. No. 5,944,227; Maddox U.S. Pat. No. 6,216,916; Maddox U.S. Pat. No. 6,390,329 and others.

One solution to this problem is the provision of a latch tongue molded into either the front cover of the dispenser or to the back plate and a latch bar or some other means for disengaging and engaging the latch tongue to release the cover for access to the interior of the dispenser in order to replace a spent container.

Refilling of these dispensers is generally a maintenance or janitorial job and it is preferable if access to the interior is limited. In some dispensers of this type, an actual key is employed to unlock the dispenser, but that requires the provision of a separate article and that in itself can be a hindrance where the key is lost or misplaced or simply not available when it is necessary to access the interior.

One drawback to the prior art with the molded latch design is that the latch tongue is integral to a large cabinet component, e.g., the front cover and, therefore, regardless of the latching arrangement used to interengage the cover with the back plate, sufficient force can be applied by a vandal, for example, to the top of the cover and, inasmuch as the dispenser components are generally fabricated from relatively light weight, thin plastic material for economy purposes, the cover will distort sufficiently to cause the dispenser cover to fly open.

Some solutions to this problem would be to make the cover very small in size and provide internal ribs for strength, but, in many installations, in order to minimize the number of times the dispenser has to be refilled, these are fairly large and that solution is not particularly feasible. It is also possible to thicken the wall thickness of the cover, but that adds to the weight of the dispenser and also incurs additional material expense.

Accordingly then, a principal object of this invention is to provide a basically tamper proof latching arrangement whereby, unless the dispenser is virtually destroyed, unauthorized access is prohibited.

SUMMARY OF THE INVENTION

It has been found that a latch which is still easy to open by authorized personnel can be provided while providing a serious impediment to unauthorized opening.

In furtherance of this object, it has been found that the latch plate carried by the cover can be slotted to interact and engage with a projecting rib or ribs on the back plate having projections which snap into the apertures in the latch plate to provide a secure engagement between the cover and back plate.

It has further been found that by providing substantial reinforcement in the form of ribs projecting from the back plate disposed so as to underlie the top of the cover when the cover is closed, unauthorized access by simply applying pressure on the top of the dispenser can be inhibited.

It accordingly becomes a principal object of this invention to provide an essentially tamper proof latch for dispensers of the nature above described with other objects thereof becoming more apparent upon a reading of the following brief specification considered and interpreted in view of the accompanying drawings.

BRIEF DESCRIPTION OF THE PREFERRED EMBODIMENTS

Figure 1:
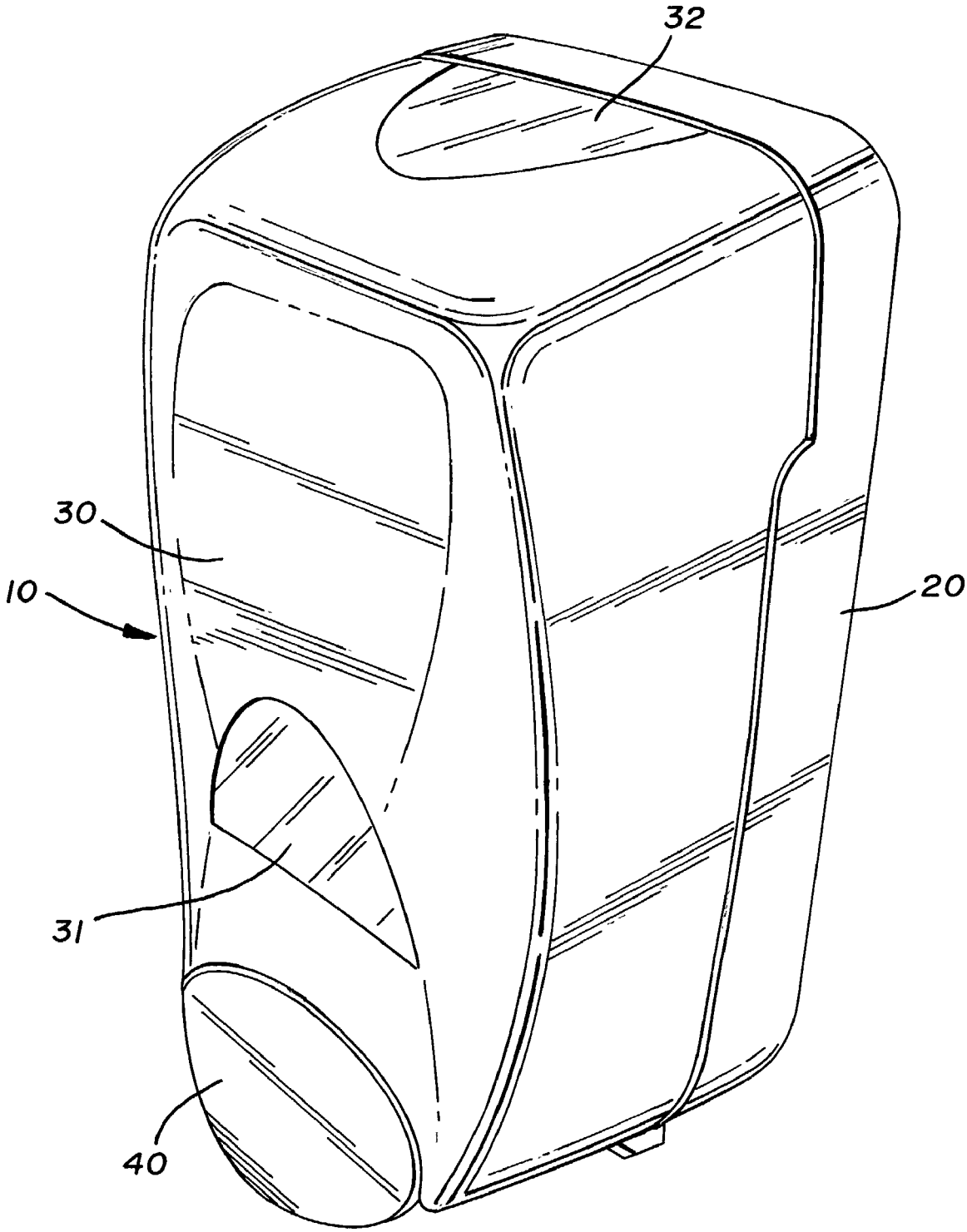
FIG. 1 is a perspective view of the dispenser in the closed position.
Figure 2:
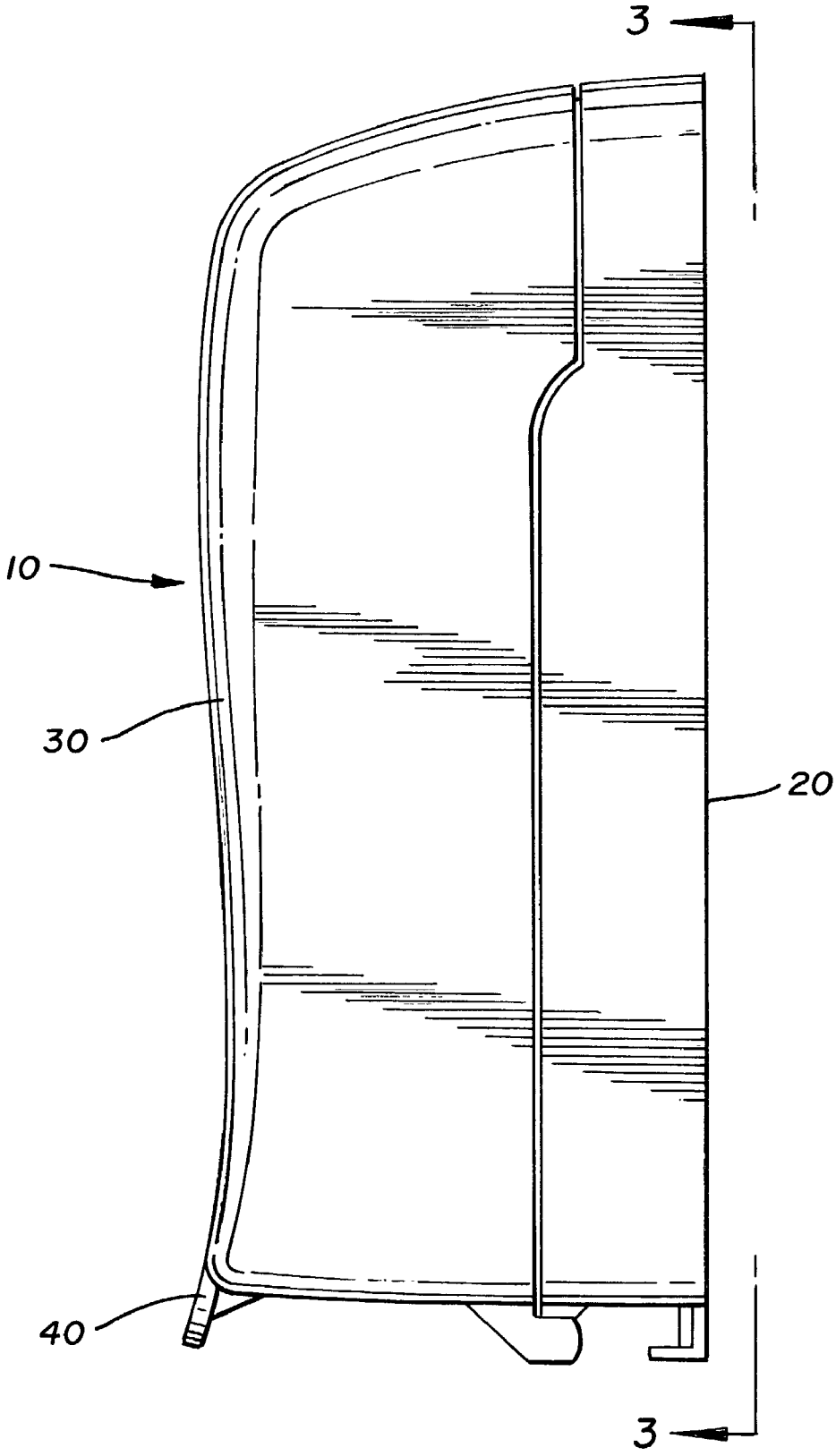
FIG. 2 is a side elevational view thereof.
Figure 3:
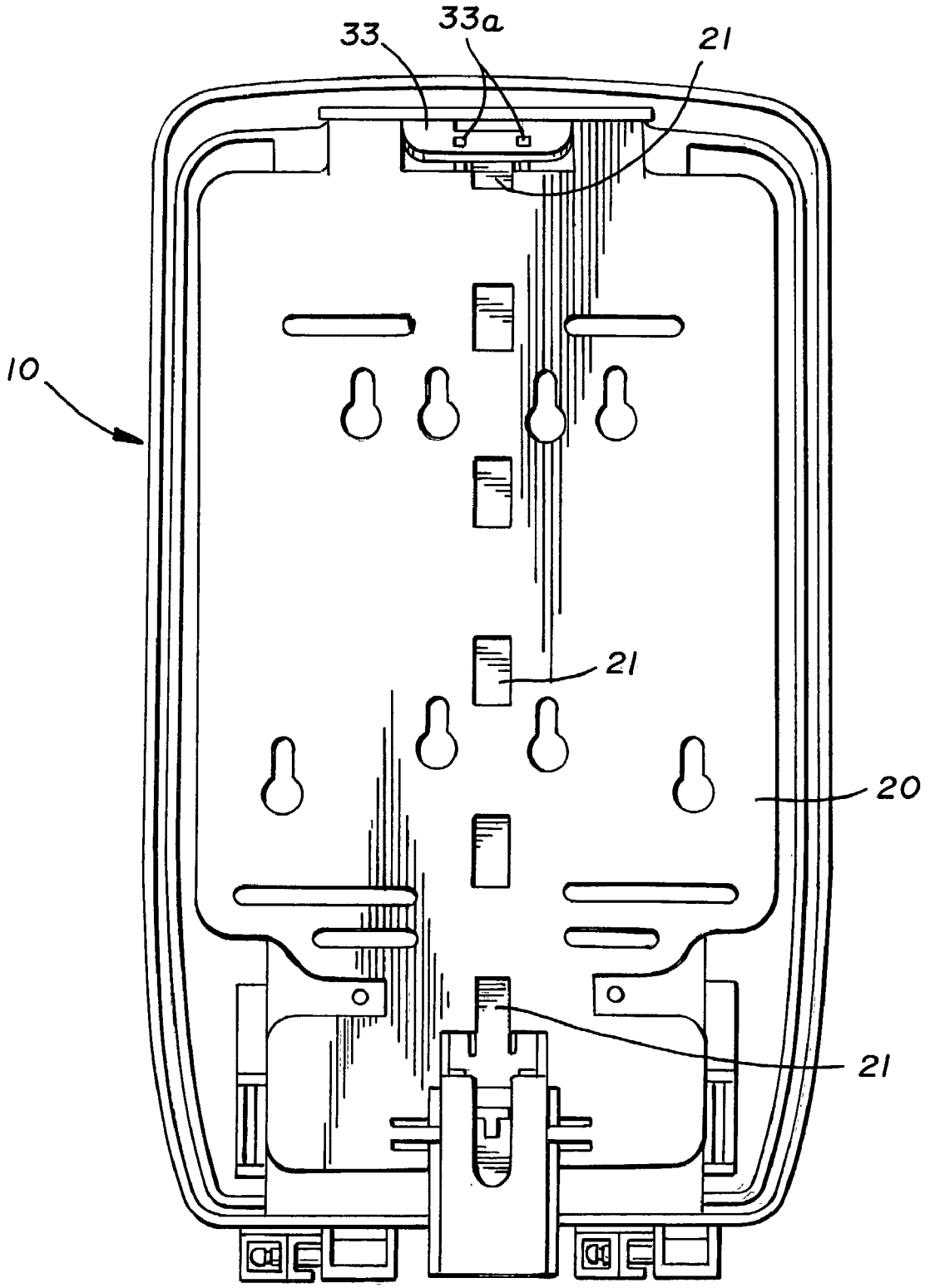
FIG. 3 is a rear elevational view thereof.

Referring first then to FIG. 1 of the drawings, it will be seen that the dispenser, generally indicated by the numeral 10, includes a back plate or wall-mounting plate 20 and a front cover 30. The front cover as illustrated in FIG. 1 also contains a push bar or activating member 40 which is intended to interact with the pump on the container contained inside the dispenser to dispense material upon applying hand force to the pressure bar or activating member 40. It will be understood that this discussion is for purposes of orienting the invention only and many different types of activating members or push bars are known in the art and could be used.

Similarly, the particular dispenser 10 illustrated and described herein includes sight windows 31 and 32 which enable one to inspect the contents to ascertain the level of the material in the container to determine whether or not the dispenser needs refilling although the invention described herein has utility in a wide variety of dispenser designs.

Turning then next to FIGS. 3–6 of the drawings, it will be seen that the back plate 20 carries a latch bar 21. This latch bar 21 is received between the back plate 20 and a retaining sleeve 22 on the back plate and is slidable in the direction of the arrow 40 to bring it into and out of engagement with the latch plate on the front cover 30 as will be explained below.

In that regard, it will be noted from FIGS. 3–6 that the cover 30 has a projecting latch plate 33 which extends downwardly toward back plate ~20 and this latch plate is apertured as at 33*a* for purposes which will be described. In operation, when the cover is moved to the closed position, the latch plate 33 slides over projections 22*b* and is engaged, as illustrated in FIG. 6 of the drawings, it can be disengaged by sliding the latch bar 21 upwardly to engage the latch plate 33 and to allow the cover to be swung to the position of FIG. 4, for example.

To that end, back plate 20 has a projecting rib 22*a* located adjacent its top end and the rib 22*a* has one or more locking projections 22*b* extending upwardly from rib 22*a*. The projections are slanted from front to rear.

Figure 5:
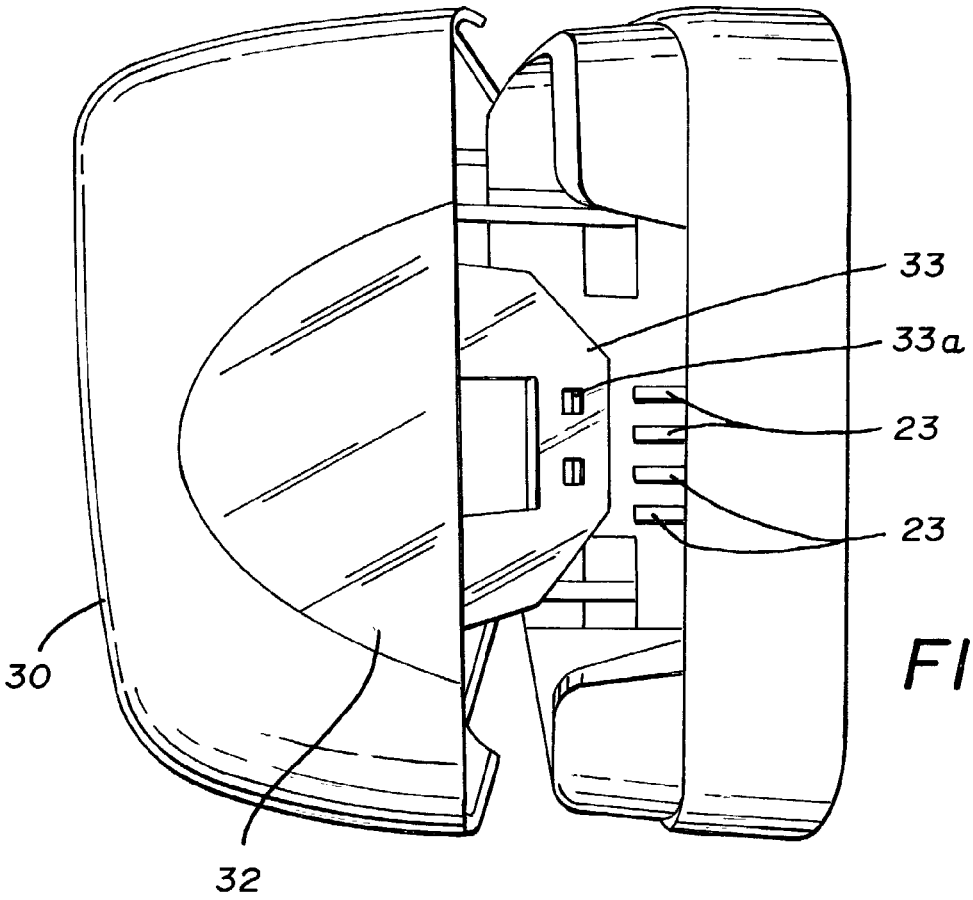
FIG. 5 is a top plan view taken along the line 5—5 of FIG. 4.
Figure 6:
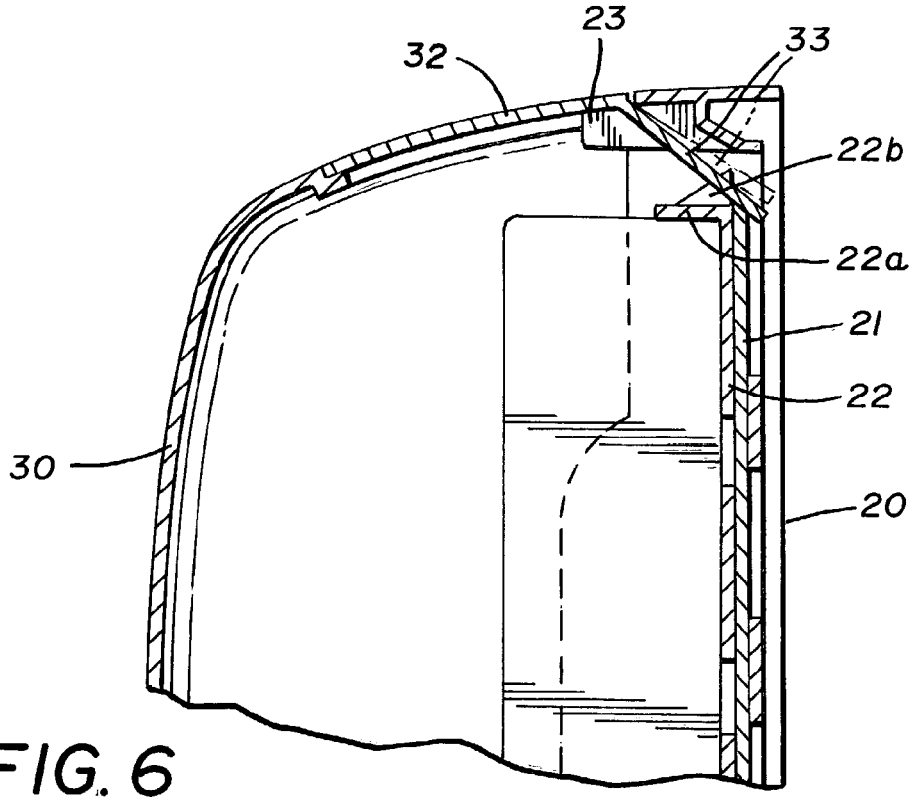
FIG. 6 is an enlarged sectional view showing the cover in the closed and latched position.

Also projecting outwardly from the back plate 20 are one or more support ribs 23, 23, best seen in FIG. 5, and it will be seen that when the cover 30 is in the closed position of FIG. 6 of the drawings, these will underlie the top of the front cover 30. In this fashion, attempts to open the dispenser without utilization of the latch bar 21 and such keying or activating devices as may be employed to move it in the direction of the arrow 40 will be substantially defeated. That is, if enough force were applied to spring the cover loose, either the cover would be fractured or the ribs 23, 23 would be broken off. In any event, the dispenser would be rendered inoperative at that time.

Figure 4:
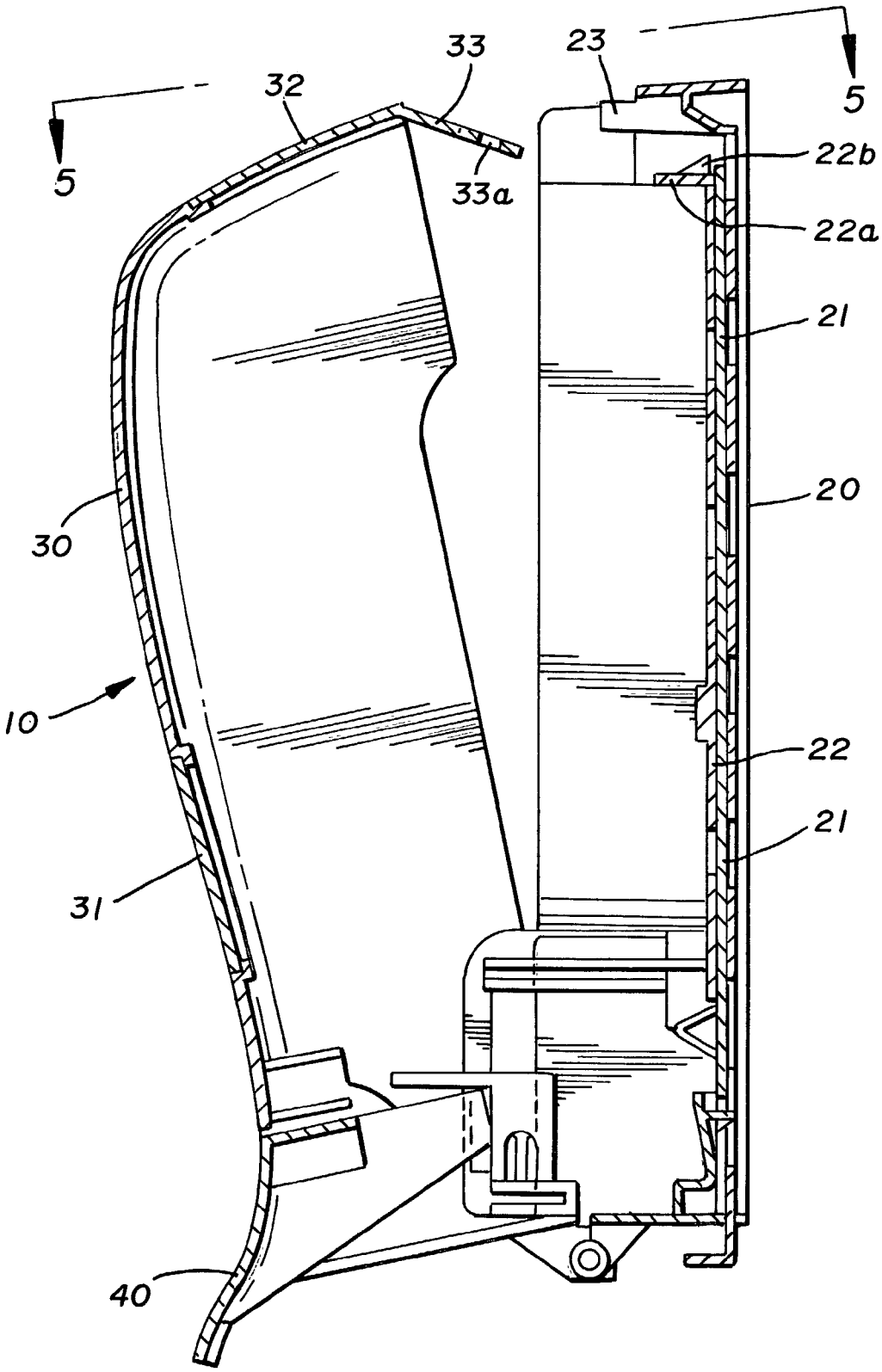
FIG. 4 is a side elevational view partially in section showing the cover in the open position.

In use or operation, it will be seen that to latch the cover 30 to the back plate 20, the device will be moved from the position of FIG. 4 to that of FIG. 6. At that time, the latch plate 33 will engage, through aperture 33*a*, the protuberance 22*b* on the back plate 20. This will also bring the ribs 23 into underlying relationship with the main cover body as contrasted to some of the prior art in which a rib is disposed beneath the latch plate per se. This arrangement precludes the possibility of simply breaking off the latch plate by applying force to the top of the cover.

While a full and complete description of the invention has been set forth in accordance with the dictates of the Patent Statutes, it should be understood that modifications can be resorted to without departing from the spirit hereof or the scope of the appended claims.

In that regard, as previously noted, a particular design of dispenser is illustrated and described herein for illustrative purposes only with it being understood that the particular latching arrangement described and claimed in this specification would have applicability to a wide variety of designs of dispensers.

What is claimed is:

1. A latching system for a dispenser having an elongate back plate, an elongate cover, one end of which is pivotably connected to one end of the back plate for movement between open and closed relationship with said back plate comprising:

a) an elongate latch bar slidably mounted on the back plate for selective movement longitudinally thereof;

b) a latch plate carried on the end of the cover opposite its point of connection to the back plate;

c) latch plate engaging means carried on the end of said back plate opposite its point of connection to the cover and releasably engagable with said latch plate to retain the cover in its closed position, wherein said latch plate engaging means is separate and distinct from said elongate latch bar, and selective movement of said elongate latch bar causes said latch bar to contact said latch plate and release said latch plate from said latch plate engaging means; and d) at least one support projection disposed on and projecting from the back plate, wherein, when the cover is in its closed position, said at least one support projection extends through an aperture in said latch plate and engages an internal surface of the cover, and the pivoting of said cover from its closed position to its open position, without employing said latch bar to release said latch plate from said latch plate engaging means, requires the breaking of said at least one support projection.

2. The latching system of claim 1 wherein said latch plate has at least one through aperture therein; said latch plate engaging means include at least one projecting rib extending toward the cover when the cover is in its closed position; and said rib including at least one engagement projection for releasably engaging said at least one through aperture in said latch plate.

3. The latching system of claim 2 wherein said engagement projections are tapered from a minimum height to a maximum height toward the back plate.

* * * * *